US007174757B1

(12) United States Patent
Tseng

(10) Patent No.: US 7,174,757 B1
(45) Date of Patent: Feb. 13, 2007

(54) LOCK CYLINDER AND KEY SET

(76) Inventor: Yuan-Cheng Tseng, No. 259, Chunghsing Rd., Nantou City (TW)

( * ) Notice: Subject to any disclaimer, the term of this patent is extended or adjusted under 35 U.S.C. 154(b) by 0 days.

(21) Appl. No.: 11/250,458

(22) Filed: Oct. 17, 2005

(51) Int. Cl.
*E05B 27/06* (2006.01)

(52) U.S. Cl. ..... 70/358; 70/401; 70/403; 70/409; 70/419; 70/493

(58) Field of Classification Search ..... 70/400, 70/401, 358, 493, 409, 419, 339, 375, DIG. 60, 70/337, 403, 404, 453, 454, 407, 420, DIG. 37, 70/DIG. 38
See application file for complete search history.

(56) References Cited

U.S. PATENT DOCUMENTS

| | | | | | |
|---|---|---|---|---|---|
| 91,610 | A | * | 6/1869 | Crosby | 70/38 C |
| 570,032 | A | * | 10/1896 | Luebbers | 70/493 |
| 900,627 | A | * | 10/1908 | Waugh et al. | 70/358 |
| 1,061,177 | A | * | 5/1913 | Hashim | 70/468 |
| 1,286,456 | A | * | 12/1918 | Vogelsang | 70/493 |
| 1,500,883 | A | * | 7/1924 | Muller | 70/358 |
| 1,905,177 | A | * | 4/1933 | Kirkwood | 70/358 |
| 2,620,649 | A | * | 12/1952 | Domingo Bernardo | 70/358 |
| 4,296,618 | A | * | 10/1981 | Guiraud | 70/358 |
| 4,341,102 | A | * | 7/1982 | Ku et al. | 70/358 |
| 4,429,555 | A | * | 2/1984 | Salsbury | 70/366 |
| 4,498,327 | A | * | 2/1985 | Preddey et al. | 72/341 |
| 4,603,565 | A | * | 8/1986 | Strassmeir | 70/358 |
| 4,787,225 | A | * | 11/1988 | Hauser et al. | 70/401 |

* cited by examiner

*Primary Examiner*—Lloyd A. Gall
(74) *Attorney, Agent, or Firm*—Rosenberg, Klein & Lee

(57) ABSTRACT

Disclosed is a lock cylinder and key set, which includes a lock cylinder, which has a keyway with two keyholes separated by a partition, and a key, which has two blades insertable into the two keyholes of the keyway for acting against respective pins in the lock cylinder to unlock the lock cylinder.

5 Claims, 5 Drawing Sheets

LOCK CYLINDER AND KEY SET

BACKGROUND OF THE INVENTION

1. Field of the Invention

The present invention relates to locking devices and more specifically, to a lock cylinder and key set of which the lock cylinder has a dual keyhole type keyway, and the key is a double blade key fitting the keyway of the lock cylinder.

2. Description of the Related Art

FIG. 1A shows a lock cylinder and key set according to the prior art. According to this design, the lock cylinder 10 has a cabinet keyway 14, a plurality of transverse holes 11 respectively perpendicularly disposed in communication with the cabinet keyway 14 in different directions, a -plurality of spring members 12 respectively mounted in the transverse holes 11, and a plurality of pins 13 respectively supported on the spring members 12 and partially projecting into the cabinet keyway 14. The key 1 is a flat blade insertable into the cabinet keyway to act against the pins 13. FIG. 1B shows another design of lock cylinder and key set according to the prior art. This design is substantially similar to the design shown in FIG. 1A with the exception that the keyway, referenced by 15, is a crossed keyway, and the key, referenced by 2, has a blade of 1, crossed cross section. FIG. 1C shows still another design of lock cylinder and key set according to the prior art. This design is substantially similar to the design shown in FIG. 1A with the exception that the keyway, referenced by 16, is a round hole, and the key, referenced by 3, has a cylindrical shank fitting the circular keyway 16.

The aforesaid conventional designs have common drawbacks. One common drawback is that a thief can insert a tool into the cabinet keyway 14, crossed keyway 15 or circular keyway 16 to unlock the lock cylinder 10 easily. Another common drawback is the weak structural strength of the lock cylinder 10. Because the lock cylinder is made of copper and the core (plug) that defines the keyway is cast from zinc aluminum alloy, the lock cylinder can easily be destroyed by a drill.

SUMMARY OF THE INVENTION

The present invention has been accomplished under the circumstances in view. It is therefore the main object of the present invention to provide a lock cylinder and key set, which provides a high security. According to one aspect of the present invention, the lock cylinder and key set comprises a lock cylinder and a key. The lock cylinder comprises a keyway, a plurality of transverse holes respectively perpendicularly disposed in communication with the keyway, a plurality of spring members respectively mounted in the transverse holes, and a plurality of pins respectively supported on the spring members and partially extending out of the transverse holes into the keyway. The key is insertable into the keyway to unlock the lock cylinder. Further, the keyway comprises a first keyhole and a second keyhole arranged in parallel and respectively disposed in communication with the transverse holes, and a partition separating the first keyhole and the second keyhole. The key has a first blade insertable into the first keyhole to act against the respective pins that project into the first keyhole, and a second blade insertable into the second keyhole to act against the respective pins that project into the second keyhole. Further, the lock cylinder is made of copper, and the partition is separately made of a different material, for example, steel, and fastened to the inside of the keyway to separate the two keyholes to reinforce the structural strength.

DETAILED DESCRIPTION OF THE PREFERRED EMBODIMENT

Figure 1A:
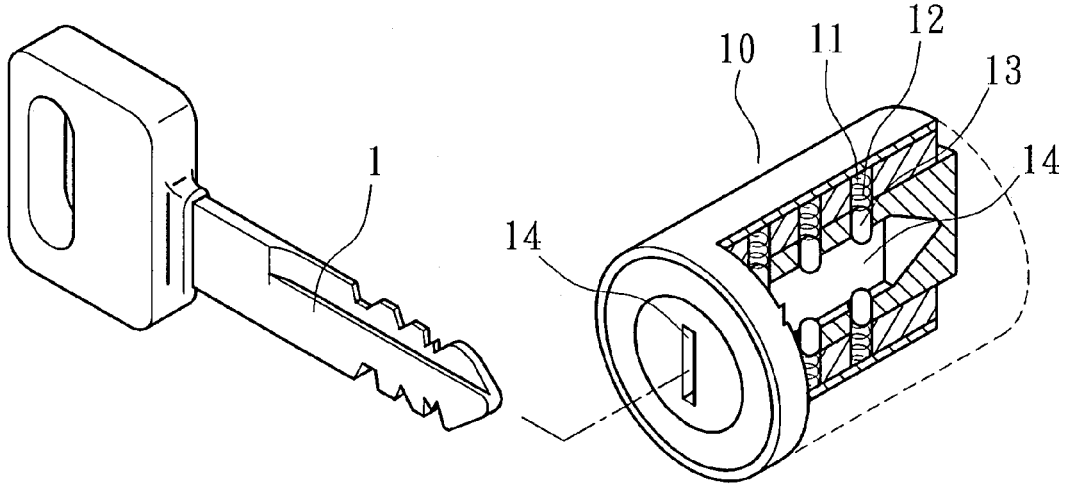
PRIOR ART FIG. 1A
FIG. 1A illustrates a lock cylinder and key set according to the prior art.
Figure 1B:
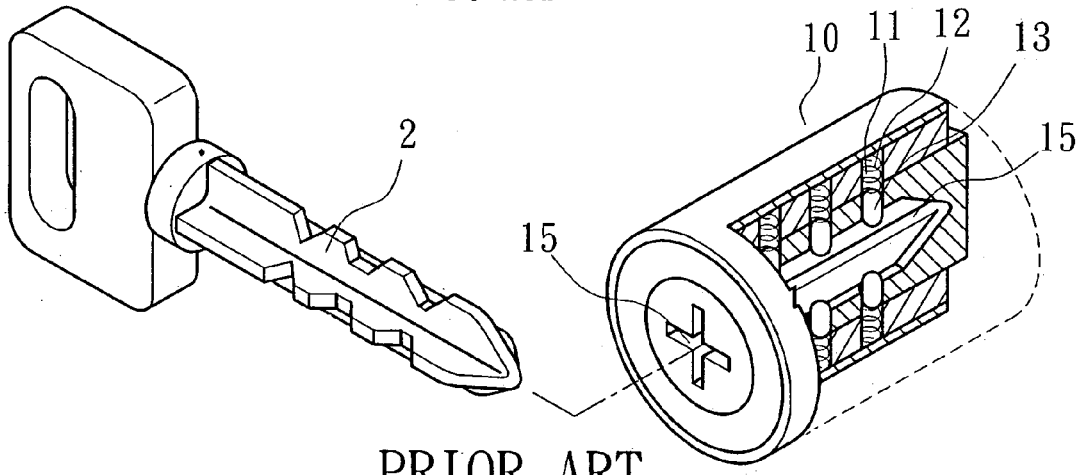
PRIOR ART FIG. 1B
FIG. 1B shows another design of lock cylinder and key set according to the prior art.
Figure 1C:
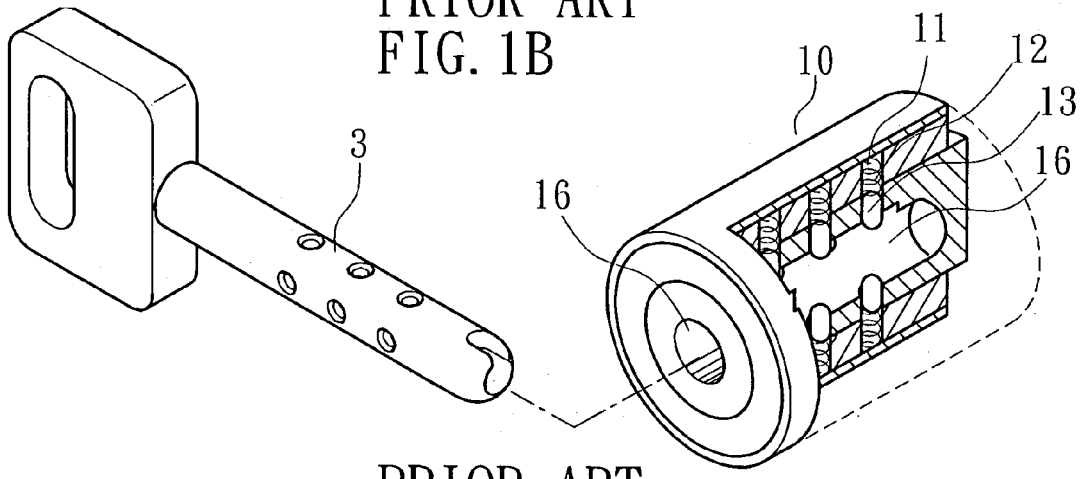
PRIOR ART FIG. 1C
FIG. 1C shows still another design of lock cylinder and key set according to the prior art.
Figure 2:
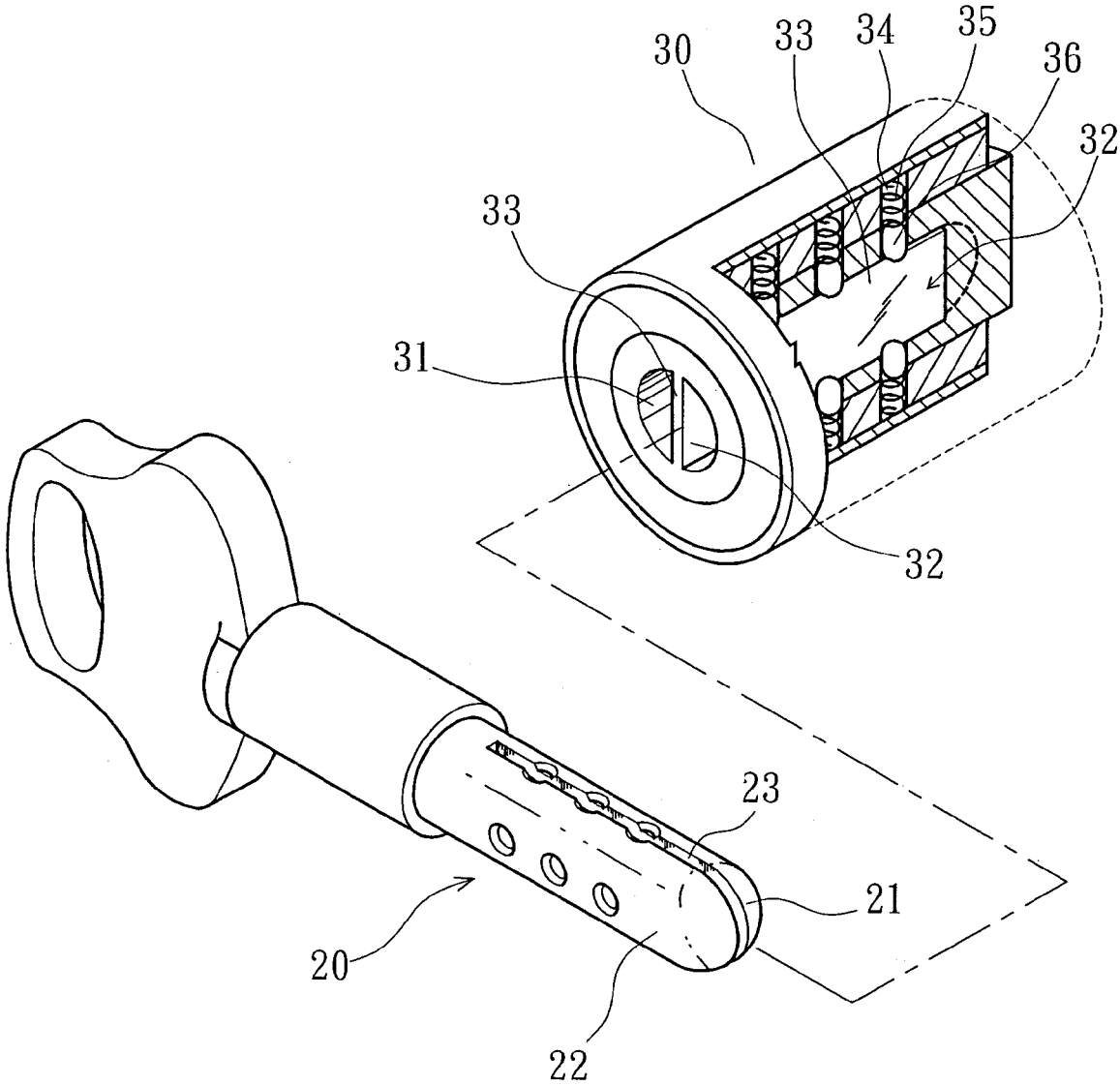
FIG. 2 illustrates a lock cylinder and key set according to the present invention.
Figure 3A:
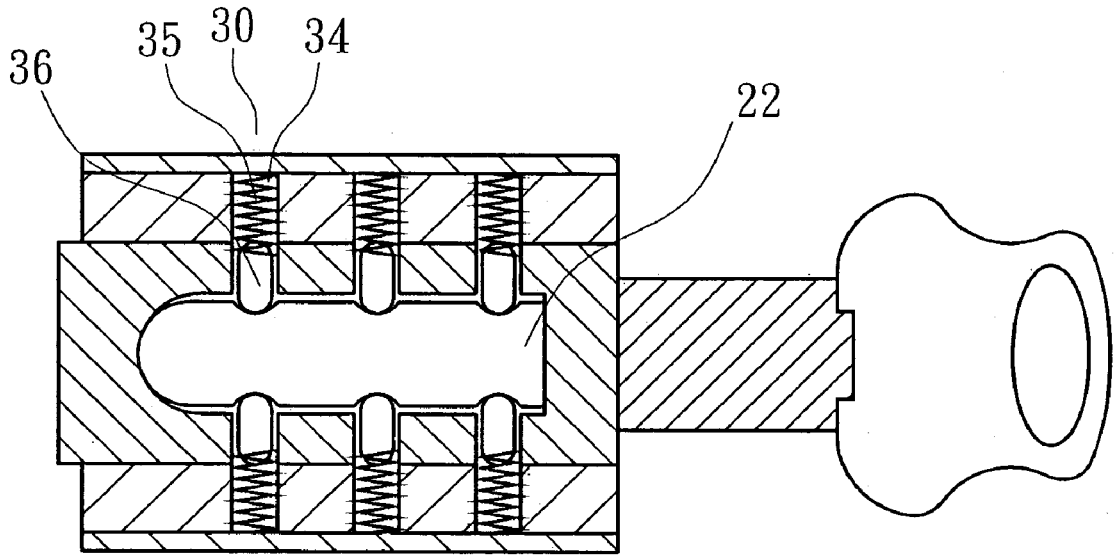
FIG. 3A is a sectional side view of the present invention, showing the key inserted into the keyway of the lock cylinder.
Figure 3B:
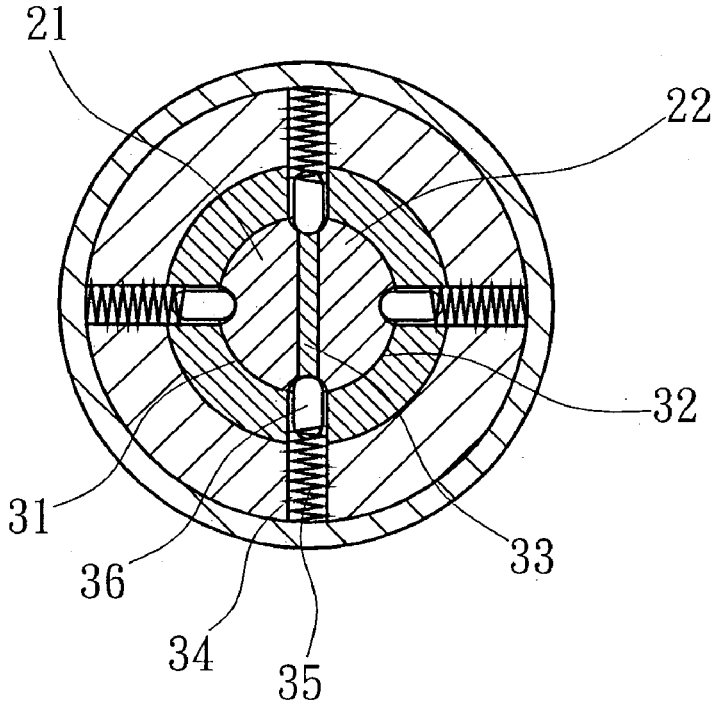
FIG. 3B is a cross sectional view of FIG. 3A.

Referring to FIGS. 2 and 3, a lock cylinder and key set in accordance with the present invention is shown comprising a lock cylinder 30 and a key 20.

The lock cylinder 30 comprises a keyway, which is formed of a first keyhole 31, a second keyhole 32 arranged in parallel to the first keyhole 31, and a partition 33 with recesses set between the first keyhole 31 and the second keyhole 32, a plurality of transverse holes 34 respectively disposed in communication with the keyholes 31 and 32 at two opposite sides, a plurality of compression springs 35 respectively mounted in the transverse holes 34, and a plurality of pins 36 respectively supported on the compression springs 35 and partially forced out of the respective transverse holes 34 into the keyholes 31 and 32.

The key 20 has a first blade 21 and a second blade 22 arranged in parallel and separated by a narrow elongated gap 23. The first blade 21 and the second blade 22 are insertable into the first keyhole 31 and the second keyhole 32 respectively, and respectively slotted or recessed for receiving the pins 36.

Because the keyway of the lock cylinder 30 has two keyholes 31 and 32 and the pins 36 are supported on the respective compression springs 35 and respectively partially forced into the two keyholes 31 and 32, the lock cylinder 30 can only be unlocked with the key 20. Inserting a tool into either of the keyhole 31 cannot unlock the lock cylinder 30. When a thief inserts two tools into the two keyholes 31 and 32 in order to unlock the lock cylinder 30, the thief cannot conveniently operate the two tools with both hands to move all pins 36 from the extended position to the received position at the same time to unlock the lock cylinder 30. Therefore, the lock cylinder and key set of the present invention provides a high security.

Figure 4A:
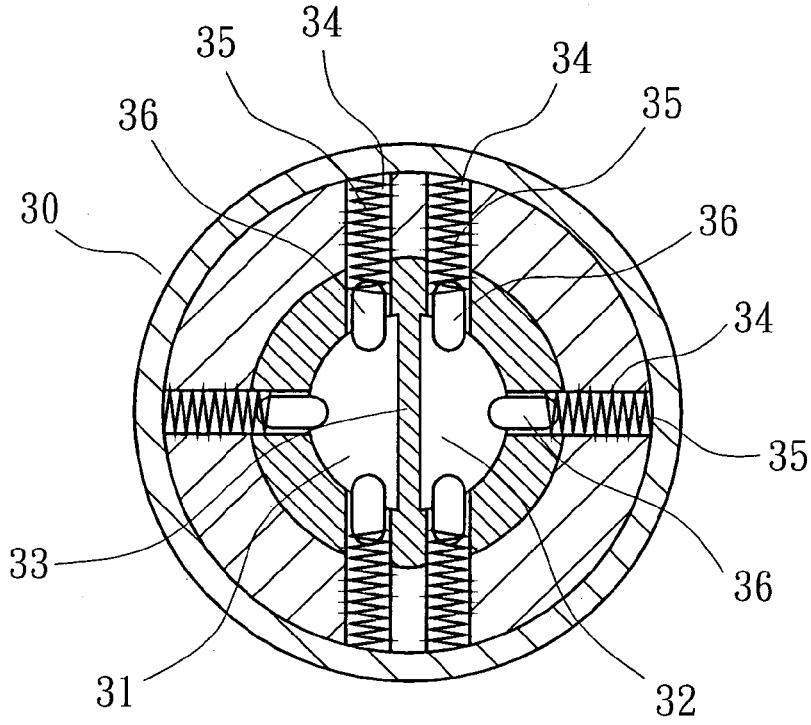
FIG. 4A is a cross sectional view of an alternate form of the present invention.
Figure 4B:
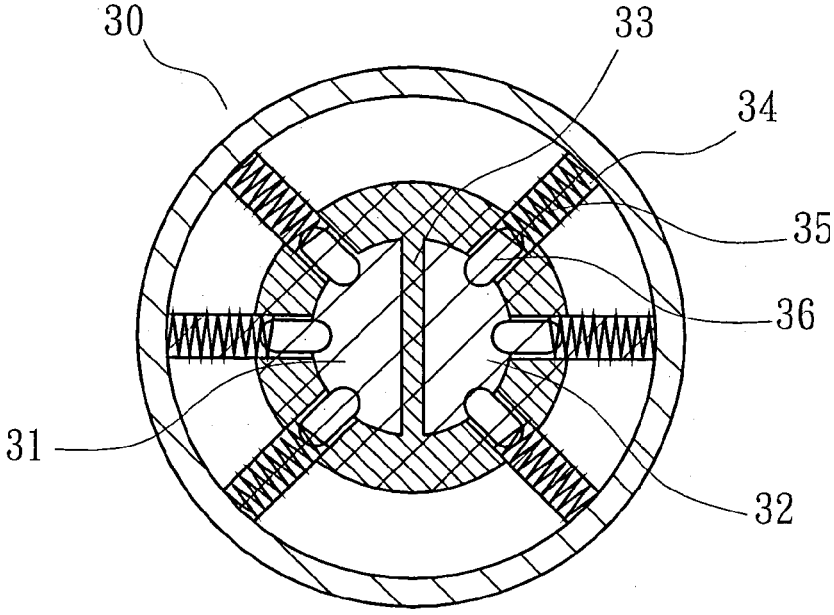
FIG. 4B is a cross sectional view of another alternate form of the present invention.

FIGS. 4A and 4B show an alternate form of the lock cylinder and key set. This embodiment is substantially similar to the aforesaid first embodiment shown in FIGS. 2 and 3 with the exception of the number and extending direction of the transverse holes 34, the compression springs 35 and the pins 36.

Figure 5A:
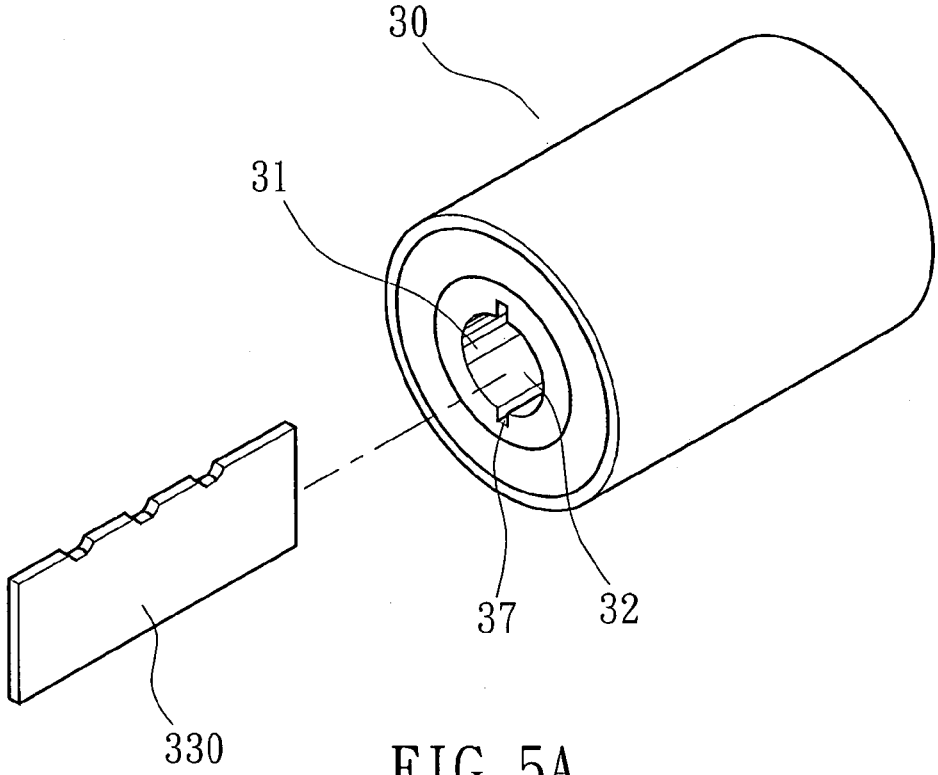
FIG. 5A is an exploded view of still another alternate form of the present invention (the key excluded).
Figure 5B:
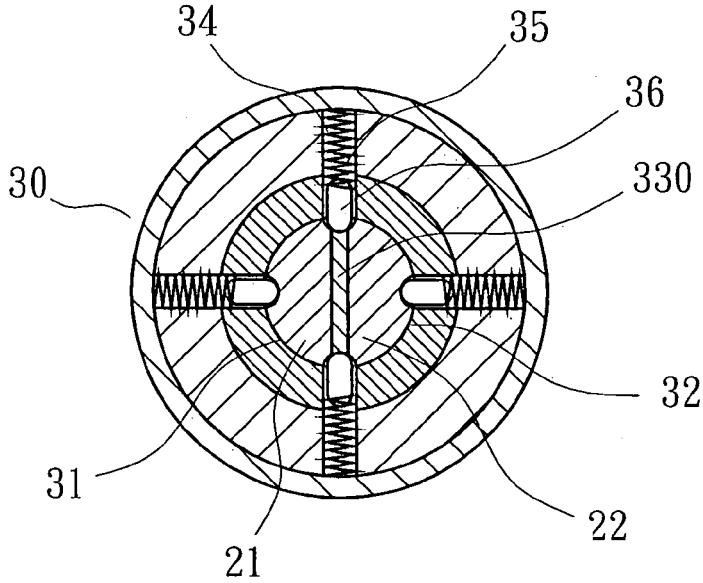
FIG. 5B is a cross sectional view showing the lock cylinder of FIG. 5A assembled.

FIGS. 5A and 5B show another alternate form of the present invention. This embodiment is substantially similar to the aforesaid first embodiment shown in FIGS. 2 and 3 with the exception that the keyway of the lock cylinder 30 has two longitudinal grooves 37, and the partition, referenced by 330 is a steel plate detachably fastened to the longitudinal grooves 37 to separate the first keyhole 31 and the second keyhole 32.

A prototype of lock cylinder and key set has been constructed with the features of the annexed drawings of FIGS. 2~5. The lock cylinder and key set functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A lock cylinder and key set comprising:

a longitudinally extending lock cylinder having a cross-sectionally arcuately contoured keyway formed therein, said lock cylinder having a plurality of biased locking pins for displacement in a radial direction with respect to a longitudinal axis of said lock cylinder;

a longitudinally extending partition member positioned in said keyway, said partition member having a plurality of partition member recesses formed within an upper surface of said partition member for receipt and obstruction of corresponding ones of said biased locking pins; and a bifurcated key member having an arcuate cross-section for mating with said keyway when said key member is slidingly displaced within said keyway on opposing sides of said partition member, said key member having a plurality of recesses formed within an outer surface of said key member for engaging therein predetermined ones of said biased locking pins.

2. The lock cylinder and key set as recited in claim 1 where said bifurcated key member has a pair of arcuately formed key blade members having a plurality of recesses formed within each of said blade members and aligned with said plurality of partition member recesses for receipt of corresponding ones of said biased locking pins within said partition recesses and said key blade recesses in combination.

3. The lock cylinder and key set as recited in claim 2 wherein predetermined ones of said locking pins are releaseably captured within predetermined ones of said partition recesses and corresponding ones of said recesses formed in said blade members.

4. The lock cylinders and key set as recited in claim 1 where said partition member is formed of a steel composition.

5. The lock cylinder and key set as recited in claim 1 where said lock cylinder is formed of a copper composition.

* * * * *